US005404678A

United States Patent [19]

Hasegawa et al.

[11] Patent Number: 5,404,678

[45] Date of Patent: Apr. 11, 1995

[54] WAFER CHAMFER POLISHING APPARATUS WITH ROTARY CIRCULAR DIVIDING TABLE

[76] Inventors: Fumihiko Hasegawa, 13-20, Miyamoto 2-chome, Urawa-shi, Saitame-ken; Tatsuo Ohtani, 89-2, Aza-Haranaka, Ooaza-Odakura ra, Nishigo-mura Nishi-shirakawa-gun, Fukushima-ken; Yasuyoshi Kuroda, 150-5, Aza-Oohira, Ooaza-Odakura a, Nishigo-mura, Nishi-Shirakawa-gun, Fukushima-ken, all of Japan

[21] Appl. No.: 72,776

[22] Filed: Jun. 7, 1993

[30] Foreign Application Priority Data

Jul. 16, 1992 [JP] Japan ..... 4-050005 U

[51] Int. Cl.[6] ..... B24B 9/06; B25B 5/00

[52] U.S. Cl. ..... 451/180; 451/401; 451/44; 451/388

[58] Field of Search ..... 51/106 R, 237 T, 145 T, 51/134, 283 E, 73 R, 283 R, 235, 284 E, 105 LG, 105 R, 106 LG, 326, 327, 103 WH

[56] References Cited

U.S. PATENT DOCUMENTS

| | | | |
|---|---|---|---|
| 2,507,998 | 5/1950 | Russell | 51/237 T |
| 5,062,384 | 11/1991 | Foley et al. | 118/500 |
| 5,094,037 | 3/1992 | Hakomori et al. | 51/165.77 |
| 5,273,615 | 12/1993 | Assetta et al. | 156/584 |
| 5,329,732 | 7/1994 | Karlsrud et al. | 51/131.5 |
| 5,335,457 | 8/1994 | Matsuda et al. | 51/284 R |

FOREIGN PATENT DOCUMENTS

| | | |
|---|---|---|
| 0222521 | 10/1986 | European Pat. Off. . |
| 1263444 | 5/1960 | France . |
| 2330254 | 12/1973 | France . |

*Primary Examiner*—Bruce M. Kisluik
*Assistant Examiner*—Yassor M. El-Gamiel
*Attorney, Agent, or Firm*—Whitham, Curtis, Whitham & McGinn

[57] ABSTRACT

A wafer chamfer polishing apparatus with a rotary circular dividing table, wherein the vacuum pump for pneumatically activating the wafer suction cups is mounted on an integral part of the rotary circular dividing table and the drive motors for dynamically activating the wafer suction cups are installed on an independent stationary body.

8 Claims, 2 Drawing Sheets

WAFER CHAMFER POLISHING APPARATUS WITH ROTARY CIRCULAR DIVIDING TABLE

This application is related to a copending application titled "A METHOD AND APPARATUS FOR WAFER CHAMFER POLISHING" for which foreign priority benefits are claimed on the basis of Japanese Patent Application No. 4-205275 filed on Jul. 31, 1992 and Japanese Utility Model Application No. 4-53886 filed on Jul. 31, 1992. Said copending application is commonly assigned with the present application.

BACKGROUND OF THE INVENTION

The present invention relates to a wafer chamfer polishing apparatus with a rotary circular dividing table, and in particular it relates to the drive mechanism for the wafer suction cups of such apparatus.

DESCRIPTION OF THE PRIOR ART

In the technology of wafer chamfer polishing, it is desirous that once a wafer is sucked and held by a suction cup the wafer stays on the same cup during the entire process of wafer chamfer polishing for the reasons of improving the wafer production efficiency and prevention of the pollution and physical damages such as chipping on the wafer.

Thus it was that various wafer chamfer polishing apparatuses with a rotary circular dividing table were proposed, wherein a plurality of wafer suction cups are arranged in the rotary circular dividing table in a manner such that each suction cup is freely rotative about its axis of rotation and the rotary table is adapted to turn step-wise, each step consisting of a turn through a certain predetermined angle, so that each wafer is kept held by the same suction cup throughout the entire course of the polishing operation in which the wafers are picked up, polished, cleaned, and eventually removed from the apparatus.

In such wafer chamfer polishing apparatuses with a rotary circular dividing table, various steps of the chamfer polishing operation are conducted simultaneously, that is, while a first wafer is being removed from the apparatus, a second one is cleaned, a third one is polished, and a fourth one is picked up by the suction cup; and what is more, there is no need of transferring a wafer from one suction cup to another, since the rotary dividing table turns to bring the wafers to their next stations; as the result, the operation efficiency is improved and the occurrences of contamination and damages of wafers such as chipping are minimized.

To effect the operation of such wafer chamfer polishing apparatuses having a rotary circular dividing table, there must be provided a drive system to turn the wafer suction cups and a pneumatic system to create negative pressure (vacuum) for wafer suction, and for this reason, a drive motor was installed in the body of the rotary table and a vacuum pump was installed on the stationary foundation in the vicinity of the rotary table. Thus, the wafer suction cups were turned round by the drive motor, and the suction cups were caused to suck air as the vacuum pump created negative pressure in the vacuum passages which connected each suction cups to the vacuum pump and part of which was formed in the rotary shaft of the rotary circular dividing table.

Problems the Invention Seeks to Solve

According to such conventional wafer chamfer polishing apparatuses having a rotary circular dividing table, since the drive motor was installed in the body of the rotary dividing table, the electric circuit connecting the power source to the drive motor to supply the electricity to the latter had to include a slip ring; also, since the suction cups were installed in the rotary body while the vacuum pump was installed on the stationary foundation, the vacuum passages connecting the vacuum pump to the suction cups to pneumatically energize the latter had to include a mechanical seal to prevent air leak at the juncture where the turning body met the stationary body.

However, the slip ring and the mechanical seal would undergo wear in a long run and thus were less reliable in maintenance of stable performance, and would oftener be the cause of malfunctions of the apparatus than other parts; hence it was desired to develop a new type of rotary circular dividing table to secure higher operation reliability of the wafer chamfer polishing apparatus.

The present invention was made in view of these problems, and it is, therefore, an object of the invention to provide a highly reliable wafer chamfer polishing apparatus with a rotary circular dividing table.

SUMMARY OF THE INVENTION

Means to Solve the Problems

In order to attain the above object of the invention, there is provided a wafer chamfer polishing apparatus with a rotary circular dividing table, consisting of a rotary system, a stationary system, and an interlock system, the rotary system comprising:

- a vertical central rotary shaft;
- a rotary body, including the rotary circular dividing table, fixedly supported by the central rotary shaft to turn together with the central rotary shaft;
- at least four wafer suction cup assemblies each having a gear and a rotary shaft and carried idly by the rotary circular dividing table in a manner such that the rotary shafts are free to spin and are arranged equidistant from, and equiangular about, the central rotary shaft; and
- a vacuum pump having a gear and fixed to the rotary body and pneumatically in communication with each wafer suction cup assembly via a vacuum controlling unit also fixed on the rotary body, the vacuum controlling unit being adapted to connect and disconnect the pneumatic communications between the vacuum pump and the wafer suction cup assemblies, selectively;

the stationary system comprising:

- a drive means for driving the central rotary shaft to turn;
- a drive means having a gear for driving the vacuum pump to create vacuum;
- as many wafer drive means as the wafer suction cup assemblies, which means each have a respective gear and are adapted to drive respective one of the suction cup assemblies to spin; and
- as many operation stations as the wafer suction cup assemblies, including a station where a wafer is picked up by a suction cup assembly, a station where the chamfers of the entire OF edge of a wafer are polished, a station where the chamfers of the entire non-OF edge of a wafer are polished, and a station where a wafer is removed from a suction cup assembly; the interlock system comprising:

an idle gear piece idly supported by the central rotary shaft to turn freely thereabout, and either directly or indirectly meshed with both the gear of the vacuum pump drive means and the gear of the vacuum pump, to transmit the rotational torque created by the vacuum pump drive means to the vacuum pump; and as many idle gear pieces as the wafer suction cup assemblies, these idle gear pieces being idly supported by the central rotary shaft to freely turn independently thereabout, and respectively meshed with both respective gears of the wafer drive means and respective gears of the wafer suction cup assemblies either directly or indirectly, to transmit the rotational torque created by the wafer drive means to the respective wafer suction cup assemblies.

In a preferred embodiment, the rotary body consists of the rotary circular dividing table and another rotary table, and the vacuum pump and the vacuum controlling unit are mounted on this another rotary table.

Preferably, each wafer suction cup assembly consists of a vertical rotary shaft having a vacuum passage running axially therethrough, a suction cup provided fixedly at one end of the shaft, and the gear provided fixedly near the other end of the shaft.

In the single embodiment given in the specification there are four wafer suction cup assemblies.

Also, in the single embodiment of the invention, each one of the gears of the wafer suction cup assemblies is meshed with the respective idle gear via one or more interconnecting idle gears.

Furthermore, in the single embodiment, the centers of the interconnecting idle gears are on the radial line connecting the center of the respective idle gear and the center of the gear of the respective wafer suction cup assembly.

In a best mode embodiment, the vacuum controlling unit should be adapted to operate in response to a signal supplied from an external source via a wireless medium.

Effects

According to this invention, the vacuum pump drive motor and the wafer drive motors are all installed on the stationary system of the wafer chamfer polishing apparatus, and the rotational torques generated by the drive motors are effectively transmitted respectively to the vacuum pump and the wafer suction cups by way of the idling gear transmission mechanisms, so that there is no longer a need for a provision of a slip ring; furthermore, since the electric power supply to the drive motors is stably effected, a high reliability can be placed on the stable operations of the wafer suction cups and the vacuum pump.

Also, the vacuum pump is installed on the turn disk, which turns in one body with the turn disk, so that the vacuum pump and the wafer suction cups are stationary relative to each other, and as the result, it is possible to connect the vacuum pump to the wafer suction cups via vacuum pipes, respectively. Consequently, there is no need for a provision of a mechanical seal which seals the juncture where the turning body meets the stationary body; hence, a still higher reliability can be expected from the rotation and suction operations of the wafer suction cups.

These and other objects and many of the attendant advantages of this invention will be readily appreciated as the same becomes better understood by reference to the following detailed description when considered in connection with the accompanying drawing.

EMBODIMENT

Next, an embodiment of the invention will be described with reference to the attached drawings.

Figure 1:
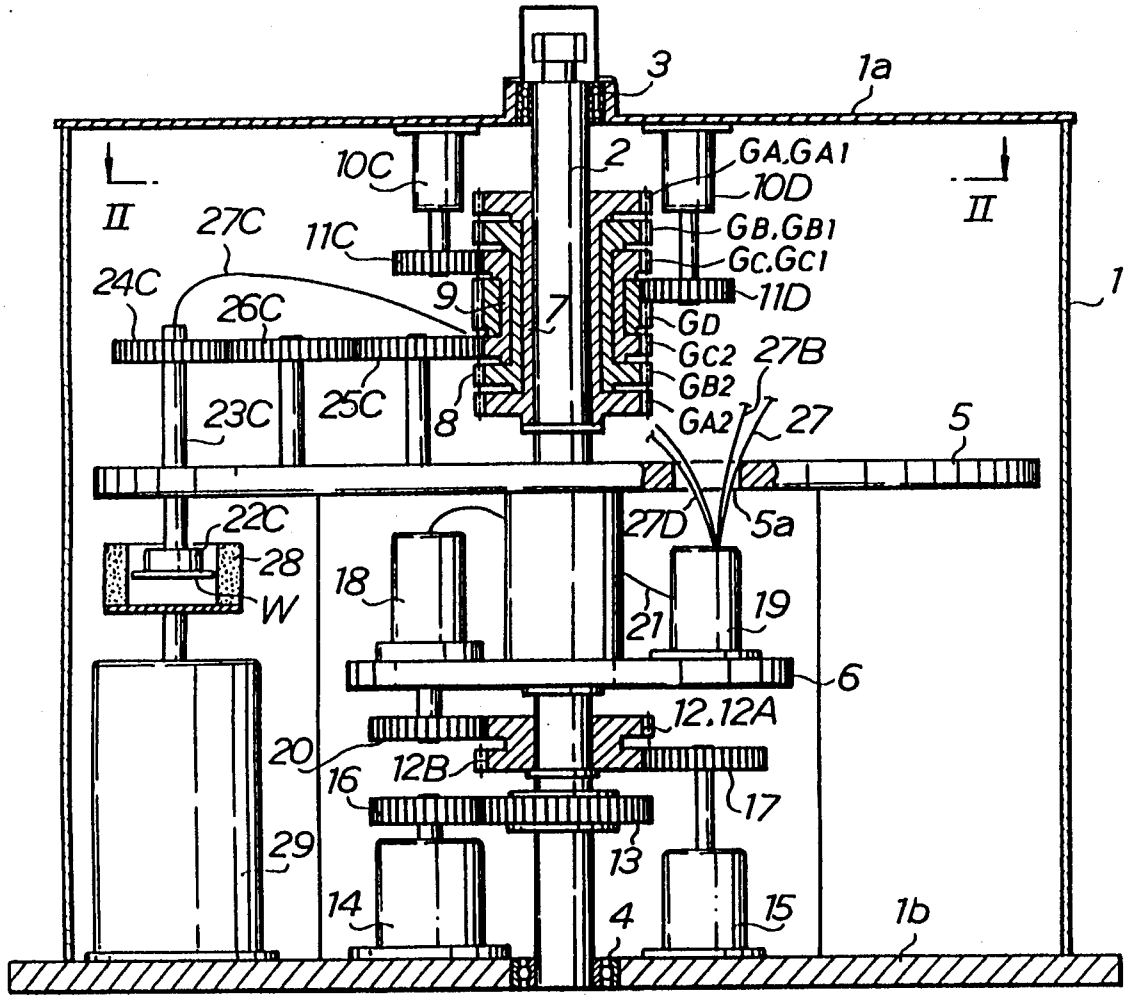
FIG. 1 is a vertical cross-sectional view of a wafer chamfer polishing apparatus with a rotary circular dividing table according to the present invention.
Figure 2:
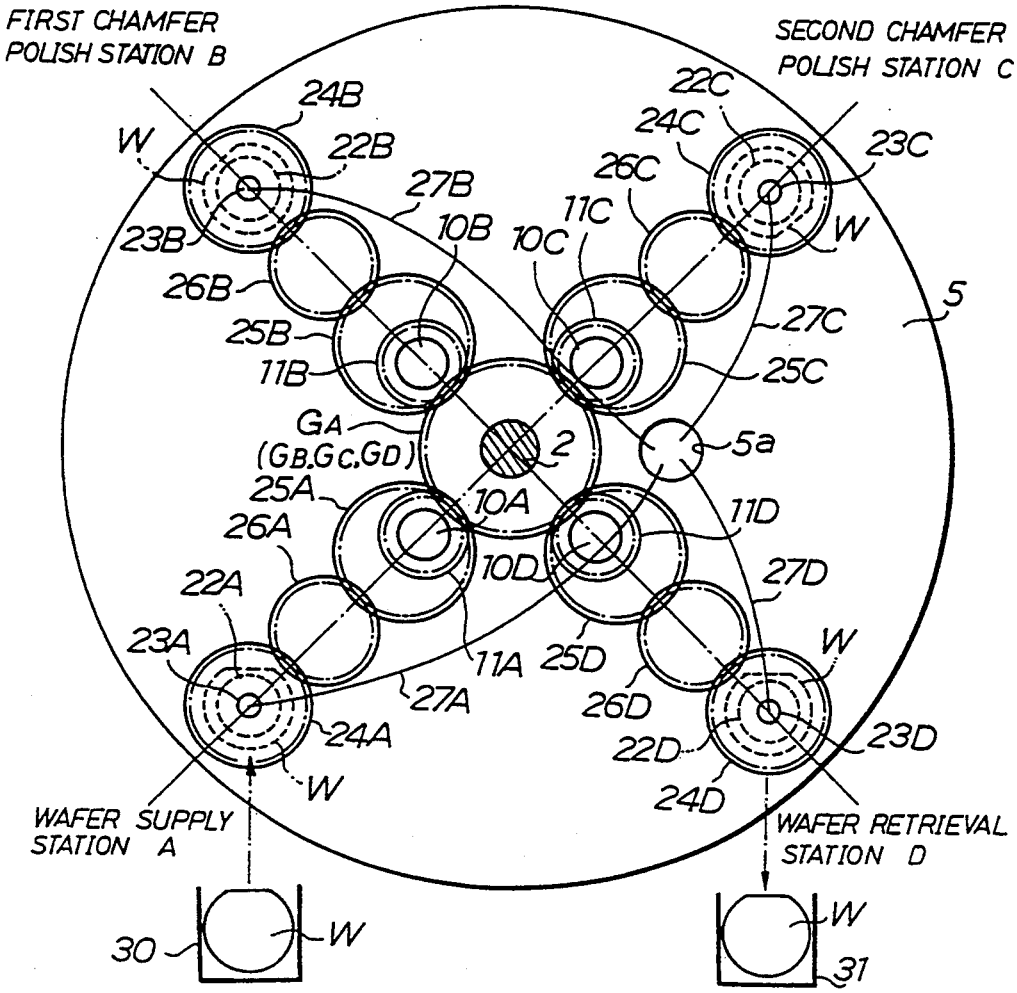
FIG. 2 is a cross-sectional view seen in the direction of arrows II—II of FIG. 1.

FIG. 1 is a vertical cross-sectional view of a wafer chamfer polishing apparatus with a rotary circular dividing table constructed according to the present invention; and FIG. 2 is a cross-sectional view seen in the direction of arrows II—II of FIG. 1.

In FIG. 1, the reference numeral 1 designates a cylindrical housing, and a vertical rotary shaft 2 is provided in the center with its upper end portion supported freely rotative by a bearing 3, which is attached to the roof 1*a* of the housing 1. The lower end portion of the rotary shaft 2 is supported freely rotative by a bearing 4 provided in the floor 1*b* of the housing 1. A circular turn disk (circular dividing table) 5 having a large-diameter is fixed on the rotary shaft 2 at a location about the middle of the height of the rotary shaft 2. Fixed below the turn disk 5 on the rotary shaft 2 is a small-diameter turn disk 6 also circular.

The rotary shaft 2 further bears three sets of idle gears $G_A$, $G_B$, $G_C$, and one gear $G_D$, which are located above the turn disk 5, and are independently and freely rotative about the rotary shaft 2. The gear set $G_A$ consists of an upper gear $G_{A1}$, a lower gear $G_{A2}$, and a sleeve 7, which integrally connects the upper and lower gears $G_{A1}$, $G_{A2}$. Between the gears $G_{A1}$ and $G_{A2}$ and about the sleeve 7 is set the gear set $G_B$ in a manner such that the latter $G_B$ is freely rotative with respect to the gear set $G_A$. The gear set $G_B$ consists of an upper gear $G_{B1}$ and a lower gear $G_{B2}$, which are integrally connected by a sleeve 8.

Similarly, the gear set $G_C$, consisting of an upper gear $G_{C1}$ and a lower gear $G_{C2}$, and a sleeve 9, is set between the gears $G_{B1}$ and $G_{B2}$ and about the sleeve 8 in a manner such that the gear set $G_C$ is freely rotative with respect to the gear set $G_B$. The idle gear $G_D$ is held between the upper gear $G_{C1}$ and the lower gear $G_C{}^2$ and about the sleeve 9 of the gear set $G_C$ in a manner such that the gear $G_D$ is freely rotative with respect to the gear set $G_C$.

On the roof 1*a* of the housing 1 are installed four wafer drive motors 10A, 10B, 10C, 10D, of which only 10C and 10D are shown in FIG. 1. As shown in FIG. 2, the drive motors 10A, 10B, 10C, 10D are arranged in a manner such that they are at the same distant from the center line of the rotary shaft 2 and the angles formed between any two neighboring drive motors with respect to the center line of the rotary shaft 2 are the same (this arrangement shall be called "equiangular", and in this embodiment the angles are all 90 degrees). The drive motors 10A, 10B, 10C, 10D have vertical output shafts of different lengths: the length of the output shaft of the drive motor 10A is such that the horizontal gear 11A, which is locked at the free end of this output shaft, meshes with the upper gear $G_{a1}$ of the idle gear set $G_A$; similarly, the lengths of the respective output shafts of the drive motors 10B and 10C are such that their horizontal gears 11B and 11C mesh with the upper gears $G_{B1}$ and $G_{C1}$, respectively; the length of the output shaft of the drive motor 10D is the longest and such that the horizontal gear 11D locked at the free end of the output shaft meshes with the upper half of the idle gear $G_D$.

An idle gear set 12 is supported by the rotary shaft 2 at a location below the small-diameter turn disk 6 in a manner such that the gear set 12 is freely rotative about the rotary shaft 2. The gear set 12 is integrally constituted by an upper gear 12A and a lower gear 12B. A gear 13 is fixed on the rotary shaft 2 at a location below the idle gear set 12.

A shaft drive motor 14 and a vacuum pump drive motor 15 are stationarily installed on the floor 1*b* of the housing 1. A horizontal gear 16 locked at the free end of the output shaft of the shaft drive motor 14 is meshed with the gear 13. Also, a horizontal gear 17 locked at the free end of the output shaft of the vacuum pump drive motor 15 is meshed with the lower gear 12B of the idle gear set 12.

A vacuum pump 18 and a vacuum control unit 19 are stationarily mounted on the turn disk 6, and the gear 20 locked at the free end of the input shaft of the vacuum pump 18 is meshed with the upper gear 12A of the idle gear set 12. The vacuum pump 18 is pneumatically connected to the vacuum control unit 19 by means of a vacuum pipe 21.

In the vicinity of the periphery of the turn disk 5 are made four vertical bores at locations equidistant from, and equiangularly with respect to, the center of the turn disk 5 (at 90-degree pitch), and through these bores are passed vertical rotary shafts 23A, 23B, 23C, and 23D in a manner such that each rotary shaft is freely rotative in the respective bore but cannot slide in it vertically. The lower ends of the rotary shafts 23A, 23B, 23C, and 23D are respectively provided with horizontal wafer suction cups 22A, 22B, 22C, and 22D; and about the upper end portions of the rotary shafts 23A, 23B, 23C, and 23D are locked, respectively, horizontal gears 24A, 24B, 24C, and 24D, which are held at such different altitudes that they are level with the lower gears $G_{A1}$, $G_{B2}$, $G_{C2}$, and the lower half of the idle gear $G_D$, respectively. As shown in FIG. 1, idle gears 25C and 26C are supported horizontally by the respective support shafts planted on the turn disk 5 in a manner such that the idle gears 25C and 26C are freely rotative and level with the gear 24C and the lower gear $G_{C2}$. Thus, the gear 24C is interconnected to the idle gear set $G_C$. In this embodiment the gears 24C, 26C, 25C (gear series C) are arranged in a radial row. Similarly as in the case of the gear series C, there are arranged gear series A, B, and D, so that when viewed in the direction of arrows X, X of FIG. 1, one can observe a gear arrangement as shown in FIG. 2.

Four vacuum pipes 27A, 27B, 27C, 27D are led out from the vacuum control unit 19, and are passed through a bore 5*a* formed in the turn disk 5 to reach the upper ends of the rotary shafts 23A, 23B, 23C, and 23D, respectively, where the vacuum pipes 27A, 27B, 27C, 27D are connected to the respective vacuum passages formed inside the rotary shafts 23A, 23B, 23C, and 23D, and are thus in communication with the respective suction cups 22A, 22B, 22C, and 22D.

As shown in FIG. 2, a wafer supply station A, a first chamfer polish station B, a second chamfer polish station C, and a wafer retrieval station D are located equiangularly with respect to the rotary shaft 2 (at 90 degree pitch) along the periphery of the turn disk 5. Although only the second chamfer polish station C is shown in FIG. 1, the four stations A, B, C, D are assembled under the turn disk 5 at locations where the wafer suction cups 22A, 22B, 22C, 22D pass as the turn disk 5 turns. The first chamfer polish station B is adapted to polish the chamfers along the orientation flat (hereinafter merely referred to as "OF") of the wafer W and it comprises a buff, not shown.

The second chamfer polish station C is adapted to polish the chamfers along the non-OF edge of the wafer W, and its rough structure is shown in FIG. 1. The second chamfer polish station C has a cylindrical buff 28, which 28 opens upward and is adapted to be turned at a predetermined rate by means of a buff drive unit 29; the cylindrical buff 28 is also adapted to shift vertically and furthermore it is capable of being pressed laterally on the turning edge of the wafer W held by the wafer suction cup 22C with a predetermined pressure, as shown in FIG. 1.

Next, the operation of the wafer chamfer polishing apparatus with a rotary circular dividing table of the present invention will be described with reference to the attached drawings.

When the turn disk (circular dividing table) 5 is turned to assume an angular position as shown in FIG. 2, the wafer suction cups 22A, 22B, 22C and 22D respectively coincide with the wafer supply station A, the first chamfer polish station B, the second chamfer polish station C, and the wafer retrieval station D. Then, at the wafer supply station A a first wafer W at the top of the wafer stack stored in the wafer cassette 30 is picked up by the wafer suction cup 22A. More particularly describing, the vacuum pump drive motor 15 is operated and its rotational torque is transmitted to the vacuum pump 18 by way of the gear 17, idle gear 12 and the gear 20, and as the result, the vacuum pump 18 is driven to create negative pressure. On this occasion, when the vacuum control unit 19 is supplied with an ON signal to command the vacuum control unit 19 to activate the suction cup 22A, by means of a wireless medium such as an LED light or an electric wave which is given from an external source, then the vacuum control unit 19 causes the wafer suction cup 22A to communicate with the vacuum pump 18 via the vacuum pipe 27A and 21 whereby the suction cup 22A starts drawing air and thus the suction cup 22A sucks and holds the first wafer W.

Meanwhile, at the first chamfer polish station B, a second wafer W (which was picked up at the wafer supply station A preceding the first wafer W) is being held by the suction cup 22B, and as the wafer drive motor 10B is operated and its rotational torque is transmitted to the wafer suction cup 22B, the second wafer W is caused to swing through a predetermined angle for a predetermined number of times. Now, it is so arranged that on this occasion the OF of the second wafer W is facing a certain direction such that as the second wafer W is swung through the predetermined angle the entire OF edge is polished by a buff, not shown. More particularly describing, the rotational torque generated by the wafer drive motor 10B is transmitted to the rotary shaft 23B by way of the gear 11B, the idle gear set $G_B$, the gears 25B, 26B, 24B and the rotary shaft 23B; as the result, the rotary shaft 23B, the wafer suction cup 22B, and the second wafer W are driven to swing in one body. As the second wafer W is swung through the predetermined angle, the chamfers of the OF edge are entirely polished by means of the buff.

At the same time, at the second chamfer polish station C also, a third wafer W (which was picked up at the wafer supply station A and had its OF chamfers polished at the first chamfer polish station B) is being held by the suction cup 22C, and as the wafer drive motor 10C is operated and its rotational torque is transmitted to the wafer suction cup 22C, the third wafer W is caused to rotate at a predetermined rate so that the chamfers of the entire non-OF edge of the wafer are polished by the cylindrical buff 28, which is also being turned round (ref. FIG. 1). More particularly describing, the rotational torque generated by the wafer drive motor 10C is transmitted to the rotary shaft 23C by way of the gear 11C, the idle gear set $G_C$, the gears 25C, 26C, 24C and the rotary shaft 23C; as the result, the rotary shaft 23C, the wafer suction cup 22C, and the third wafer W are driven to rotate in one body. As the third wafer W is rotated thus, the chamfers of the non-OF edge are entirely polished by means of the cylindrical buff 28.

In the meantime, at the wafer retrieval station D, a fourth wafer W (which was picked up at the wafer supply station A and had its OF and non-OF chamfers polished at the first and second chamfer polish stations B and C) is being held by the suction cup 22D, and at this station D that portions of the wafer W which are not covered by the suction cup 22D are cleaned. On this occasion, when the vacuum control unit 19 is supplied by the external source with an OFF signal to command the vacuum control unit 19 to deactivate the suction cup 22D, then the vacuum control unit 19 causes the wafer suction cup 22D to cease communicating with the vacuum pump 18 whereby the suction cup 22D stops drawing air and thus the suction cup 22D lets go the fourth wafer W, which is then carried by a transportation means, not shown, and is inserted in a cassette 31.

Thus, as the respective operations at the wafer supply station A, the first chamfer polish station B, the second chamfer polish station C, and the wafer retrieval station D are completed, the shaft drive motor 14 is operated to turn its output shaft for a predetermined revolutions whereby the rotational torque is transmitted to the rotary shaft 2 by way of the gears 16 and 13, and as the result the rotary shaft 2 together with the turn disks 5, 6 is caused to turn clockwise through an angle of 90 degrees so that the wafer suction cups are indexed to the respective next stations: that is, the first wafer W picked up by the wafer suction cup 22A at the wafer supply station A is now staying at the first chamfer polish station B; similarly the second wafer W polished at the first chamfer polish station B is now at the second chamfer polish station C; the third wafer W polished at the second chamfer polish station C is now stopping at the wafer retrieval station D. Each of these four wafers receives the respective operation as described above at the respective station.

The wafer suction cup 22D, which has released the fourth wafer W at the wafer retrieval station and is therefore empty-handed, is moved to the wafer supply station A to pick up another wafer W from the wafer cassette 30.

As this set of simultaneous operations is repeated four times, the turn disk 5 completes one turn and meanwhile the wafer which is picked up at the wafer supply station A at the beginning of the turn is polished at the first chamfer polish station B and at the second chamfer polish station C and is inserted in the wafer cassette 30. Thus, each time the turn disks 5 and 6 turn a quarter of a revolution, one wafer is added to the wafers in the cassette 31.

According to this embodiment, the vacuum pump drive motor 15 and the wafer drive motors 10A, 10B, 10C, 10D are all installed on the stationary side of the wafer chamfer polishing apparatus, and the rotational torques generated by the drive motors 15 and 10A–10D are effectively transmitted respectively to the vacuum pump 18 and the wafer suction cups 22A–22D by way of the gear transmission mechanisms, so that there is no longer a need for a provision of a slip ring; furthermore, since the electric power supply to the drive motors 15 and 10A–10D is stably effected, a high reliability can be placed on the stable operations of the wafer suction cups 22A–22D and the vacuum pump 18.

Also, the vacuum pump 18 is installed on the turn disk 6, which turns in one body with the turn disk 5, so that the vacuum pump 18 and the wafer suction cups 22A–22D are stationary relative to each other, and as the result, it is possible to connect the vacuum pump 18 to the wafer suction cups 22A–22D via vacuum pipes 21 and 21A–27D, respectively. Consequently, there is no need for a provision of a mechanical seal which seals the juncture where the turning body meets the stationary body; hence, a still higher reliability can be expected from the rotation and suction operations of the wafer suction cups 22A–22D.

Obviously many modifications and variations of the present invention are possible in the light of the above teachings. It is therefore to be understood that within the scope of the appended claims the invention may be practiced otherwise than is specifically described.

What is claimed is:

1. A wafer chamfer polishing apparatus with a rotary circular dividing table, consisting of a rotary system, a stationary system, and an interlock system, said rotary system comprising:

a vertical central rotary shaft;

a rotary body, including said rotary circular dividing table, fixedly supported by said central rotary shaft to turn together with the central rotary shaft;

at least four wafer suction cup assemblies each having a gear and a rotary shaft and carried idly by said rotary circular dividing table in a manner such that the rotary shafts are free to spin and are arranged to be equidistant from, and equiangular about, the central rotary shaft; and a vacuum pump having a gear and fixed to said rotary body and pneumatically in communication with each wafer suction cup assembly via a vacuum controlling unit also fixed on said rotary body, said vacuum controlling unit being adapted to connect and disconnect the pneumatic communications between the vacuum pump and the wafer suction cup assemblies, selectively;

said stationary system comprising:

a drive means for driving said central rotary shaft to turn;

a drive means having a gear for driving said vacuum pump to create vacuum;

as many wafer drive means as the wafer suction cup assemblies, which means each have a respective gear and are adapted to drive respective one of the suction cup assemblies to spin; and as many operation stations as the wafer suction cup assemblies, including a station where a wafer is picked up by a suction cup assembly, a station where the chamfers of the entire OF edge of a wafer are polished, a station where the chamfers of the entire non-OF edge of a wafer are polished, and a station where a wafer is removed from a suction cup assembly; said interlock system comprising:

an idle gear piece idly supported by said central rotary shaft to turn freely thereabout, and either directly or indirectly meshed with both said gear of the vacuum pump drive means and said gear of the vacuum pump, to transmit the rotational torque created by said vacuum pump drive means to said vacuum pump; and as many idle gear pieces as the wafer suction cup assemblies, these idle gear pieces being idly supported by said central rotary shaft to freely turn independently thereabout, and respectively meshed with both respective gears of the wafer drive means and respective gears of the wafer suction cup assemblies either directly or indirectly, to transmit the rotational torque created by said wafer drive means to the respective wafer suction cup assemblies.

2. The wafer chamfer polishing apparatus as claimed in claim 1, wherein said rotary body consists of said rotary circular dividing table and another rotary table, and said vacuum pump and said vacuum controlling unit are fixed to said another rotary table.

3. The wafer chamfer polishing apparatus as claimed in claim 1, wherein each wafer suction cup assembly comprising of said rotary shaft being vertical and having a vacuum passage running axially therethrough, a suction cup provided fixedly at one end of the shaft, and said gear provided fixedly near the other end of the shaft.

4. The wafer chamfer polishing apparatus as claimed in claim 1, wherein there are four wafer suction cup assemblies.

5. The wafer chamfer polishing apparatus as claimed in claim 1, wherein each one of said gears of the wafer suction cup assemblies is meshed with the respective idle gear via one or more interconnecting idle gears.

6. The wafer chamfer polishing apparatus as claimed in claim 5, wherein the centers of said interconnecting idle gears are on the radial line connecting the center of the respective idle gear and the center of the gear of the respective wafer suction cup assembly.

7. The wafer chamfer polishing apparatus as claimed in claim 1, wherein said vacuum pump has an input rotary shaft with said gear provided fixedly at the end of said shaft.

8. The wafer chamfer polishing apparatus as claimed in claim 1, wherein said vacuum controlling unit is adapted to operate in response to a signal supplied from an external source via a wireless medium.

* * * * *